US011476557B1

(12) United States Patent
Sharma et al.

(10) Patent No.: US 11,476,557 B1
(45) Date of Patent: Oct. 18, 2022

(54) DUAL-POLARIZATION HEAT-DISSIPATING ANTENNA ARRAY ELEMENT

(71) Applicant: The United States of America, as represented by the Secretary of the Navy, San Diego, CA (US)

(72) Inventors: Satish K. Sharma, Escondido, CA (US); Jia-Chi Samuel Chieh, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/395,673

(22) Filed: Aug. 6, 2021

(51) Int. Cl.

| | |
|---|---|
| ***H01Q 1/02*** | (2006.01) |
| ***H01Q 21/06*** | (2006.01) |
| ***H01Q 21/00*** | (2006.01) |
| ***H01Q 13/08*** | (2006.01) |
| ***H01Q 23/00*** | (2006.01) |
| ***H01Q 25/00*** | (2006.01) |

(52) U.S. Cl.
CPC ..... *H01Q 1/02* (2013.01); *H01Q 13/085* (2013.01); *H01Q 21/0081* (2013.01); *H01Q 21/064* (2013.01); *H01Q 23/00* (2013.01); *H01Q 25/001* (2013.01)

(58) Field of Classification Search
CPC ..... H01Q 1/02; H01Q 13/08; H01Q 13/085; H01Q 21/0081; H01Q 21/062; H01Q 21/064; H01Q 21/0075; H01Q 21/24; H01Q 21/26; H01Q 23/00; H01Q 25/001
See application file for complete search history.

(56) References Cited

U.S. PATENT DOCUMENTS

| | | | | |
|---|---|---|---|---|
| 8,350,767 | B2 | 1/2013 | Brigham | |
| 2019/0067823 | A1* | 2/2019 | Irion, II | H01Q 15/24 |
| 2020/0091621 | A1* | 3/2020 | Huang | H01Q 13/085 |

OTHER PUBLICATIONS

S. M. Duffy, et al., "Stepped Notch Antenna Array Used as a Low Thermal Resistance Heat Sink," 2013 IEEE Antennas and Propagation Society International Symposium (APSURSI), 2013, pp. 622-623.

R. Banerjee, et al., "Investigations of All Metal Heat Sink Dual Linear Polarized Phased Array Antenna for Ku-Band Applications," 2020 International Applied Computational Electromagnetics Society Symposium (ACES), 2020, pp. 1-2.

(Continued)

*Primary Examiner* — Robert Karacsony
(74) *Attorney, Agent, or Firm* — Naval Information Warfare Center, Pacific; Kyle Eppele; James McGee

(57) ABSTRACT

An antenna element transfers a radiofrequency signal and dissipates heat. The antenna element includes a periphery and first and second pairs of fins. The periphery has a length and a width with the length approximately equaling the width. The first and second pairs of fins extend in height from inside the periphery. The first pair of fins are separated by a shared gap for transferring a first polarization of the radiofrequency signal, and the second pair of fins are separated by the shared gap for transferring a second polarization of the radiofrequency signal that is orthogonal to the first polarization. An antenna array includes multiple instances of the antenna element for transferring the radiofrequency signal and for dissipating the heat.

14 Claims, 5 Drawing Sheets

(56) References Cited

OTHER PUBLICATIONS

T. Q. Tran, et al., "Radiation Characteristics of a Multimode Concentric Circular Microstrip Patch Antenna by Controlling Amplitude and Phase of Modes," IEEE Transactions on Antennas and Propagation, vol. 60, No. 3, pp. 1601-1605, Mar. 2012.
N. R. Labadie, et al., "A Circularly Polarized Multiple Radiating Mode Microstrip Antenna for Satellite Receive Applications," IEEE Transactions on Antennas and Propagation, vol. 62, No. 7, pp. 3490-3500, Jul. 2014.
B. Babakhani, et al., "Dual Null Steering and Limited Beam Peak Steering Using Triple-Mode Circular Microstrip Patch Antenna," IEEE Transactions on Antennas and Propagation, vol. 65, No. 8, pp. 3838-3848, Aug. 2017.

* cited by examiner

DUAL-POLARIZATION HEAT-DISSIPATING ANTENNA ARRAY ELEMENT

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 113632.

BACKGROUND OF THE INVENTION

A phase array antenna includes a beamformer for steering and shaping an antenna beam of the phase array antenna. The beamformer typically includes a converter for each antenna element in the phase array antenna. The respective converter for each antenna element sets the phase and amplitude for the antenna element, and the phase and amplitude distribution across the antenna elements of the phased array antenna electronically steers and shapes the antenna beam. To match phase delays from signal propagation, the respective converter for each antenna element is typically disposed nearby the antenna element. The respective converters for the antenna elements in the phase array antenna generate significant heat from the amplifiers and other circuitry required to set the phase and amplitude for each antenna element, and this heat generated nearby the antenna elements should be dissipated without blocking the steerable range of the antenna beam.

SUMMARY

An antenna element transfers a radiofrequency signal and dissipates heat. The antenna element includes a periphery and first and second pairs of fins. The periphery has a length and a width with the length approximately equaling the width. The first and second pairs of fins extend in height from inside the periphery. The first pair of fins are separated by a shared gap for transferring a first polarization of the radiofrequency signal, and the second pair of fins are separated by the shared gap for transferring a second polarization of the radiofrequency signal that is orthogonal to the first polarization. An antenna array includes multiple instances of the antenna element for transferring the radiofrequency signal and for dissipating the heat.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

Figure 1A:
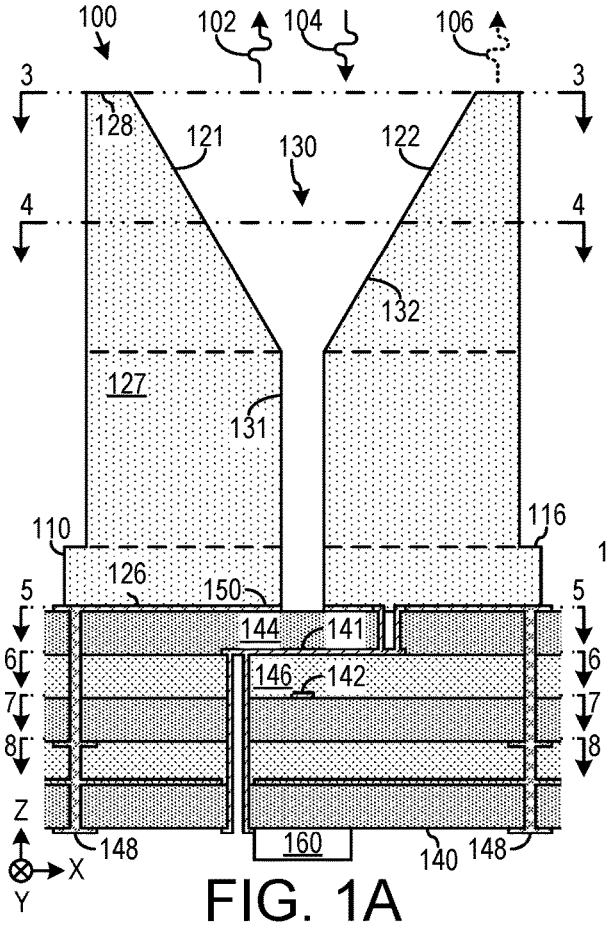
FIG. 1A and FIG. 1B side views of an antenna element of an antenna array in accordance with an embodiment of the invention.

The Inventors have discovered that the antenna beam from an antenna element of an antenna array is determined primarily by the geometry of the gap between a pair of antenna blades and the height of the antenna blades, but the antenna beam is weakly affected by the geometry of the antenna blades away from the gap between the antenna blades. Thus, the antenna blades can be broadened away from the gap between the antenna blades to become heat-dissipating fins, because this broadening increases the surface area of the heat-dissipating fins and because passive heat dissipation through radiation and convection depends strongly upon the available surface area. Such heat-dissipating fins not only radiate and collect a radiofrequency signal, but also dissipate the heat generated in transceiver circuits that electronically steer a composite antenna beam from all of the antenna elements in the antenna array.

The Inventors have also discovered that the gap between a first pair of antenna blades of an antenna element can be shared with a second pair of antenna blades having an orthogonal orientation to the first pair of antenna blades. The first and second pairs of antenna blades radiate and collect orthogonal polarizations of the radiofrequency signal. Furthermore, the second pair of antenna blades doubles the available antenna blades that can be broadened away from the shared gap to become heat-dissipating fins. Such heat dissipating fins not only radiate and collect orthogonal polarizations of the radiofrequency signal, but also efficiently dissipate the heat generated in the respective transceiver circuits for the antenna elements in the antenna array.

The Inventors have further discovered novel feedlines that enable radiating and collecting the orthogonal polarizations of the radiofrequency signal, without significant crosstalk between the orthogonal polarizations. These novel feedlines also enable driving each pair of dipole-like antenna fins from a single-ended electrical signal with better than 10 dB of isolation between the orthogonal polarizations of the radiofrequency signal.

The Inventors have yet further discovered that when the base of each antenna element in an antenna array is framed with a peripheral wall, the peripheral wall provides mechanical stability without affecting the antenna beam. This mechanical stability accurately establishes the horizontal and vertical pitches of the antenna elements in the antenna array, especially when the peripheral walls are connected (see FIG. 3B) or shared (see FIG. 3C and FIG. 3D) during 3D printing of metal composing the first and second pairs of fins onto a printed circuit board.

The disclosed antenna elements and antenna arrays below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1B:
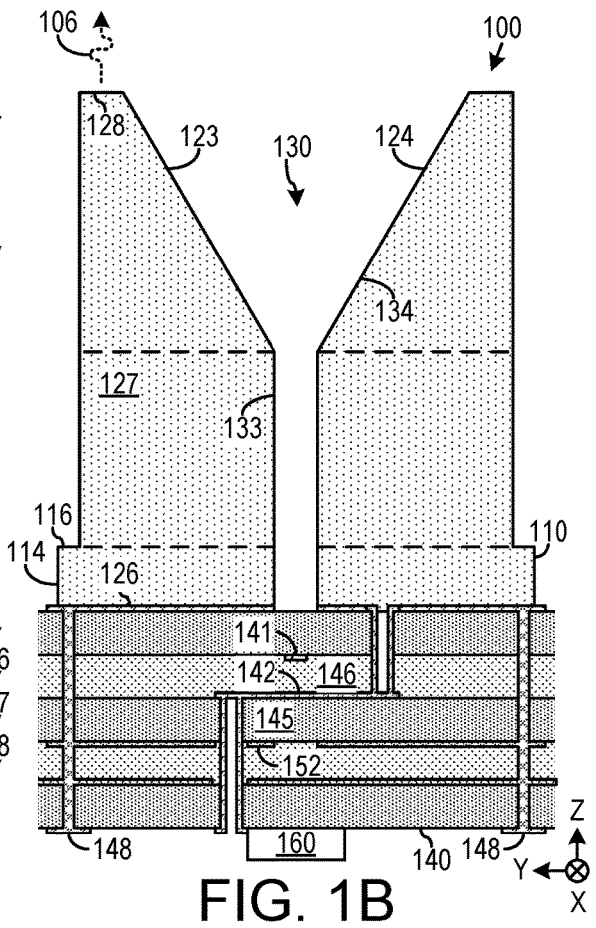
Figure 1C:
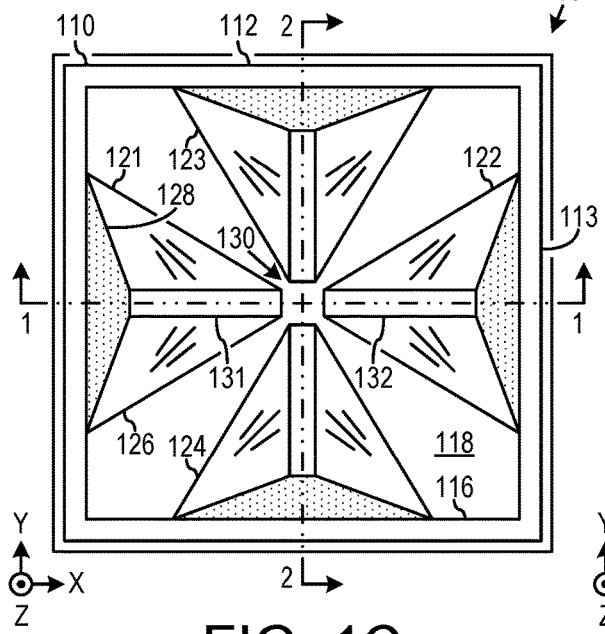
FIG. 1C is a top plan view from section 3-3 in FIG. 1A of an antenna element of an antenna array in accordance with an embodiment of the invention.

FIG. 1A and FIG. 1B perpendicular side views of an antenna element 100 of an antenna array in accordance with an embodiment of the invention. FIG. 1C is a top plan view from section 3-3 in FIG. 1A of an antenna element 100 of an antenna array in accordance with this embodiment of the invention. FIG. 1A is a side view from section 1-1 in FIG. 1C and FIG. 1B is a perpendicular side view from section 2-2 in FIG. 1C.

The antenna element 100 for the antenna array transfers a radiofrequency signal and dissipates heat 106. Transferring the radiofrequency signal includes radiating the radiofrequency signal 102 during a transmit mode and/or collecting the radiofrequency signal 104 during a receive mode. Dissipating the heat 106 includes radiation and convection.

The antenna element 100 includes a periphery 110 with a length 112 along an X-axis approximately equaling a width 113 along a Y-axis. In a preferred embodiment, the length 112 equals the width 113. The periphery 110 includes a peripheral wall 116 forming a square cavity 118 inside the peripheral wall 116. The peripheral wall 116 has a height 114 along the Z-axis and has the length 112 along the X-axis approximately equaling the width 113 along the Y-axis.

First and second pairs of fins extend out of the square cavity 118 along a Z-axis and inside the periphery 110. The first pair of fins includes a first fin 121 and a second fin 122, and the second pair of fins includes a third fin 123 and a fourth fin 124. In one embodiment, the first and second pairs of fins 121, 122, 123, and 124 are composed of metal for conveying the heat 106 through these fins and for passively dissipating the heat 106 through radiation and convection. In another embodiment, one or more fans surround the antenna array of antenna elements to blow air across each antenna element 100 and improve dissipating the heat 106 through convection.

The first pair of fins 121 and 122 are separated by a shared gap 130 along the X-axis, and the second pair of fins 123 and 124 are separated by the shared gap 130 along the Y-axis. The first pair of fins 121 and 122 and the shared gap 130 are configured to radiate and/or collect a first polarization of the radiofrequency signal, and the second pair of fins 123 and 124 and the shared gap 130 are configured to radiate and/or collect a second polarization of the radiofrequency signal that is orthogonal to the first polarization. In one embodiment, the first polarization of the radiofrequency signal is a first linear polarization and the second polarization of the radiofrequency signal is a second linear polarization, with the first linear polarization perpendicular to the second linear polarization.

FIG. 1C is a top plan view from section 3-3 in FIG. 1A of an antenna element 100 of an antenna array in accordance with this embodiment of the invention. Section 3-3 passes through the flat top 128 of fin 121. The shared gap 130 between faces 131 and 132 of the first pair of fins 121 and 122 monotonically increases along the Z-axis from a bottom 126 to the top 128 of the first pair of fins 121 and 122 for transferring the first polarization of the radiofrequency signal 102 or 104. Similarly, the shared gap 130 between faces 133 and 134 of the second pair of fins 123 and 124 monotonically increases from the bottom 126 to the top 128 for transferring the second polarization of the radiofrequency signal 102 or 104. In one embodiment, the shared gap 130 between the first pair of fins 121 and 122 has a constant separation along the X-axis from the bottom 126 to a middle 127 and has a linearly increasing separation along the X-axis from the middle 127 to the top 128. Similarly, the shared gap 130 between the second pair of fins 123 and 124 has the constant separation along the Y-axis from the bottom 126 to the middle 127 and has the linearly increasing separation along the Y-axis from the middle 127 to the top 128.

Figure 1D:
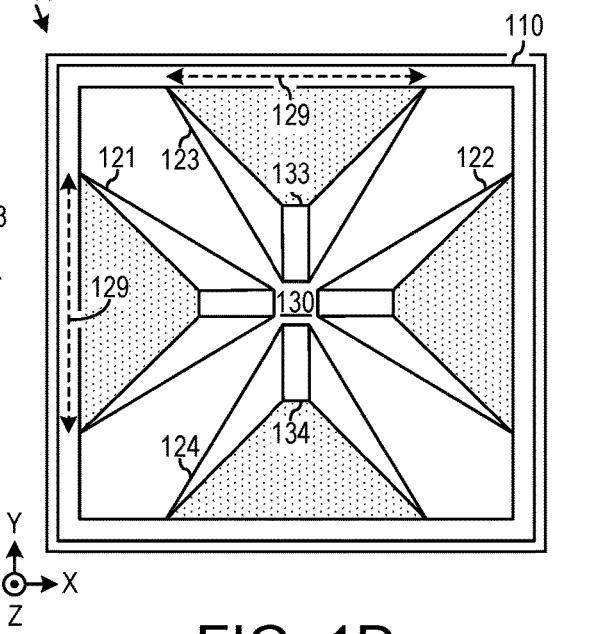
FIG. 1D is a cross-sectional view from section 4-4 in FIG. 1A through fins of an antenna element of an antenna array in accordance with an embodiment of the invention.

FIG. 1D is a cross-sectional view from section 4-4 in FIG. 1A through fins 121, 122, 123, and 124 of an antenna element 100 of an antenna array in accordance with an embodiment of the invention. FIG. 1D shows a cross-sectional view through fins 121, 122, 123, and 124 where the shared gap 130 has the linearly increasing separation between the middle 127 and the top 128 of fins 121, 122, 123, and 124.

To dissipate the heat 106, the first pair of fins 121 and 122 broadens along the Y-axis with increasing distance away from the shared gap 130 along the X-axis, and the second pair of fins 123 and 124 broadens along the X-axis with increasing distance away from the shared gap 130 along the Y-axis. In one embodiment, at each height along the Z-axis between the bottom 126 and the top 128, the first pair of fins 121 and 122 linearly broadens along the Y-axis with increasing distance along the X-axis from the shared gap 130 towards the periphery 110, and, at each height along the Z-axis between the bottom 126 and the top 128, the second pair of fins 123 and 124 linearly broadens along the X-axis with increasing distance along the Y-axis from the shared gap 130 towards the periphery 110. The first pair of fins 121 and 122 linearly broadens along the Y-axis to a same breadth 129 at the periphery 110 for each height along the Z-axis between the bottom 126 and the top 128 even though the shared gap 130 between the first pair of fins 121 and 122 monotonically increases from the bottom 126 to the top 128. Similarly, the second pair of fins 123 and 124 linearly broadens along the X-axis to the same breadth 129 at the periphery 110 for each height along the Z-axis between the bottom 126 and the top 128 even though the shared gap 130 between the second pair of fins 123 and 124 monotonically increases from the bottom 126 to the top 128.

Returning to FIG. 1A and FIG. 1B, the antenna element 100 includes a printed circuit board 140, A first feedline 141, a second feedline 142, a first balun 144, and a second balun 145 are implemented with a respective conductive layer of the printed circuit board 140. The feedlines 141 and 142 and the baluns 144 and 145 are enclosed between ground planes stitched together with ground vias 148 around the periphery 110. In one optimized embodiment, there are eight ground vias per antenna element 100, with corresponding spacing between the ground vias as shown in FIG. 1A-H. The printed circuit board 140 supports and directly contacts the first and second pairs of fins 121, 122, 123, and 124.

FIG. 1E, FIG. 1F, FIG. 1G, and FIG. 1H are cross-sectional views from respective sections 5-5, 6-6, 7-7, and 8-8 in FIG. 1A through conductive layers of the printed circuit board 140 for an antenna array in accordance with an embodiment of the invention.

Figure 1E:
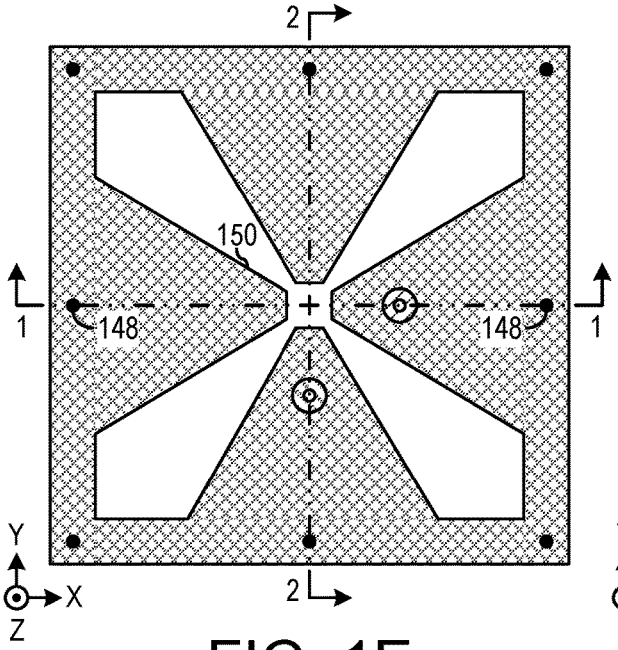
FIG. 1E, FIG. 1F, FIG. 1G, and FIG. 1H are cross-sectional views from respective sections 5-5, 6-6, 7-7, and 8-8 in FIG. 1A through conductive layers of a printed circuit board for an antenna array in accordance with an embodiment of the invention.
Figure 1F:
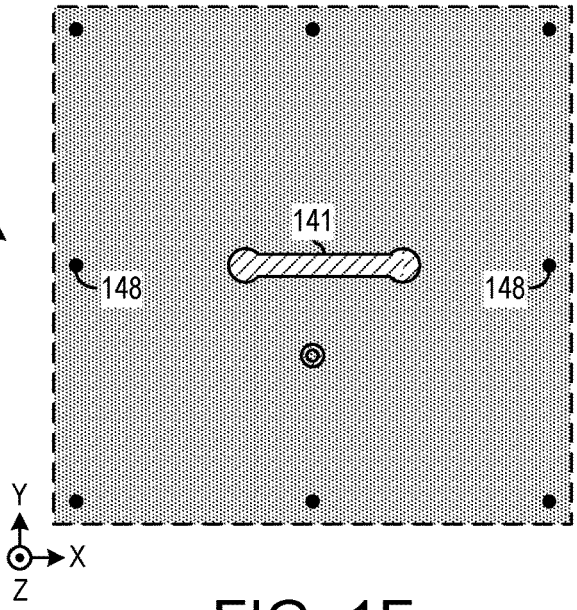
Figure 1G:
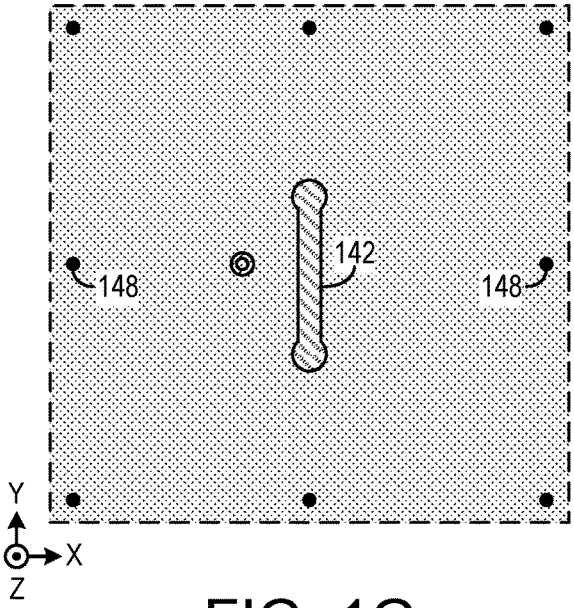

The first feedline 141 includes a stripline between ground planes and blind vias connecting the stripline between a transceiver circuit 160 and the fin 122 of the first pair. The first feedline 141 directly drives the fin 122 of the first pair, and the first feedline 141 couples through the first balun 144 for indirectly driving the grounded fin 121 of the first pair. Referring to FIG. 1E, the first balun 144 includes a trapezoidal portion 150 of a ground plane adjacent the stripline of the first feedline 141.

Figure 1H:
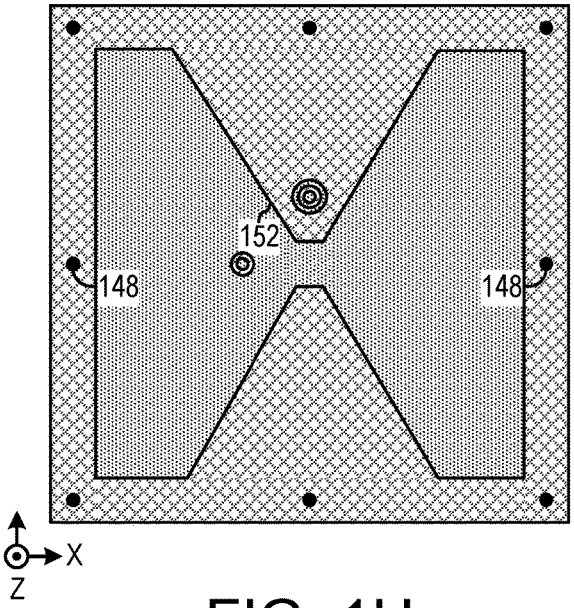

Similarly, the second feedline 142 includes a stripline between the ground planes and blind vias connecting the stripline between a transceiver circuit 160 and the fin 124 of the second pair. The second feedline 142 directly drives the fin 124 of the second pair, and the second feedline 142 couples through the second balun 145 for indirectly driving the grounded fin 123 of the second pair. Referring to FIG. 1H, the second balun 145 includes a trapezoidal portion 152 of a ground plane adjacent the stripline of the second feedline 142.

The first feedline 141 in its respective conductive layer and the second feedline 142 in its respective conductive layer cross perpendicular to each other underneath the shared gap 130 along the Z-axis, but separated along the Z-axis by a dielectric layer 146 of the printed circuit board 140. This perpendicular crossing between the first and second feedlines 141 and 142 minimizes crosstalk between the first and second feedlines 141 and 142.

The transceiver circuit 160 is mounted on the printed circuit board 140 opposite the first and second pairs of fins 121, 122, 123, and 124. The first and second pairs of fins 121, 122, 123, and 124 dissipate the heat 106 conveyed through the printed circuit board 140 from the transceiver circuit 160 when the transceiver circuit 160 transmits and/or receives the first and second polarizations of the radiofrequency signal 102 or 104. The transceiver circuit 160 includes, or is coupled to, an antenna controller.

The antenna controller is adapted to control an amplitude gain and a phase delay of the radiofrequency signal 102 or 104 passing through the transceiver circuit 160 for electronically steering a direction and a composite polarization of an antenna beam for transmitting and/or receiving the radiofrequency signal 102 or 104.

In one embodiment, the length 112 and width 113 of the periphery 110 of the peripheral wall 116 are each 11 mm. A thickness of the peripheral wall 116 is 0.5 mm so that the square cavity 118 has dimensions of 10 mm by 10 mm, and the height 114 of the peripheral wall 116 is 1.5 mm. The shared gap 130 between faces 131 and 132 of the first pair of fins 121 and 122 has a constant separation of 1 mm from the bottom 126 to a middle 127, and linearly increases up to 8 mm from middle 127 to the top 128. Similarly, the shared gap 130 between faces 133 and 134 of the second pair of fins 123 and 124 has a constant separation of 1 mm from the bottom 126 to a middle 127, and linearly increases up to 8 mm from the middle 127 to the top 128. Between the bottom 126 and the top 128, a breath of the faces 131, 132, 133, and 134 of the fins 121, 122, 123, and 124 is 0.6 mm, and the fins 121, 122, 123, and 124 linearly broaden away from the shared gap 130 to a same breadth 129 of 6 mm. A height of the fins 121, 122, 123, and 124 above the printed circuit board 140 is from 10 mm to 13 mm. The dielectric layer 146 and other dielectric layers of the printed circuit board 140 are composed of microwave laminate materials.

For this embodiment, a thermal simulation of passive dissipation of heat 106 from a 4×8 array of antenna elements 100 with the above dimensions shows a temperature range across the surface area of the fins 121, 122, 123, and 124 of 163° C. to 165° C. into stagnant air at 20° C. with 0.25 Watt of heat generated in each transceiver circuit 160.

Figure 2A:
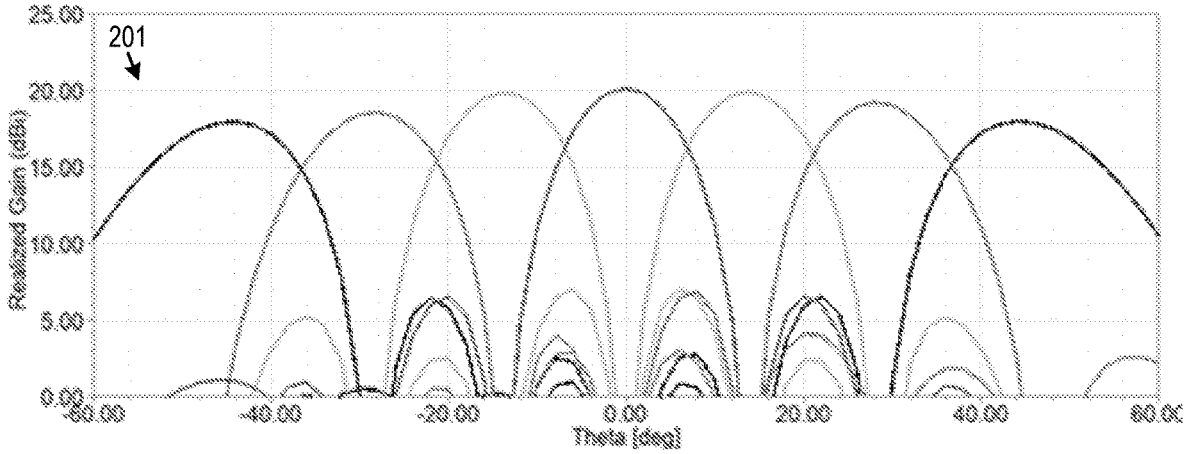
FIG. 2A-D are plots showing beam steering performance for progressive phase shifts along the X-axis and Y-axis in accordance with an embodiment of the invention.
Figure 2B:
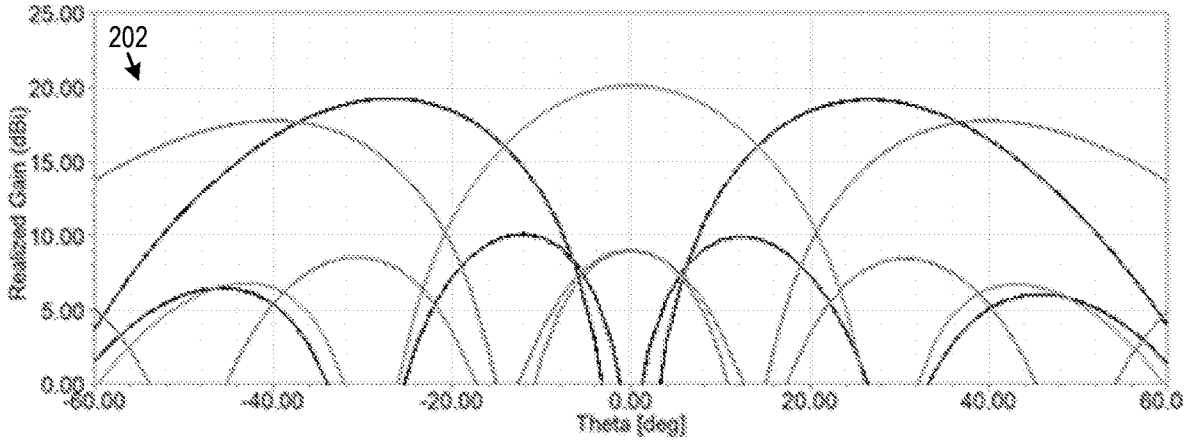
Figure 2C:
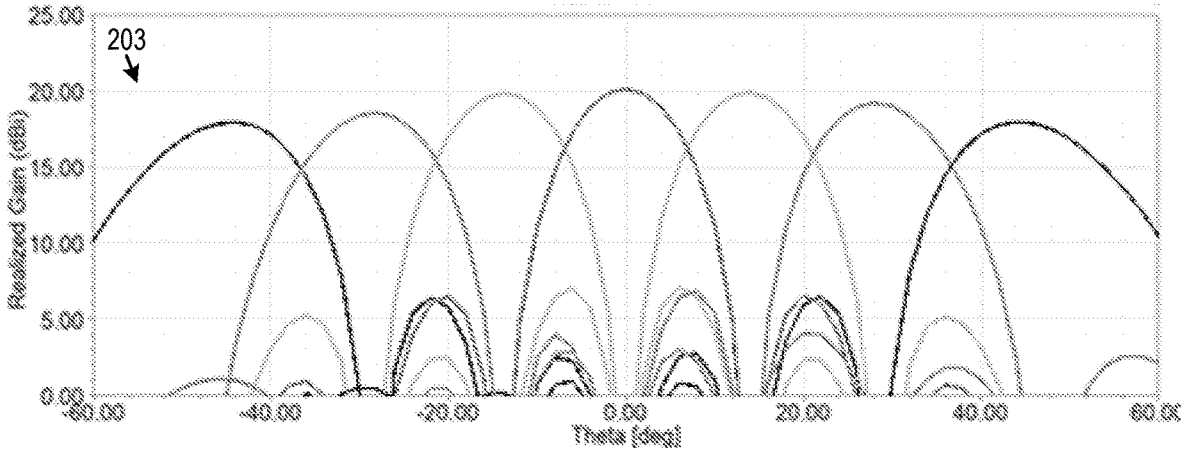
Figure 2D:
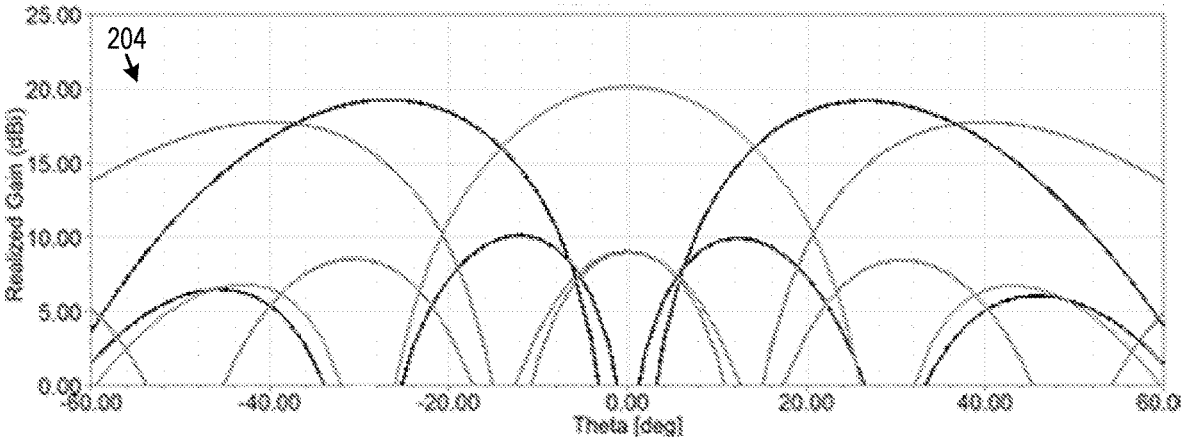

FIG. 2A-D are plots showing beam steering performance for an antenna array of 4×8 antenna elements when the antenna controller appropriately sets a respective amplitude gain and a respective phase delay for each an instance of antenna element 100 in the antenna array. FIG. 2A-D show simulated beam steering performance for progressive phase shifts along the X-axis and Y-axis in accordance with an embodiment of the invention. FIG. 2A and FIG. 2C show phase shifts of 0°, ±45°, ±90°, and ±135°, and FIG. 2B and FIG. 2D show phase shifts of 0°, ±90°, and ±135°. FIG. 2A and FIG. 2B are plots 201 and 202 showing beam steering along the X-axis and Y-axis, respectively, when the first pair of fins 121 and 122 transfer a linear polarization aligned along the X-axis. FIG. 2C and FIG. 2D are plots 203 and 204 showing beam steering along the X-axis and Y-axis, respectively, when the second pair of fins 123 and 124 transfer a linear polarization aligned along the Y-axis.

Figure 3A:
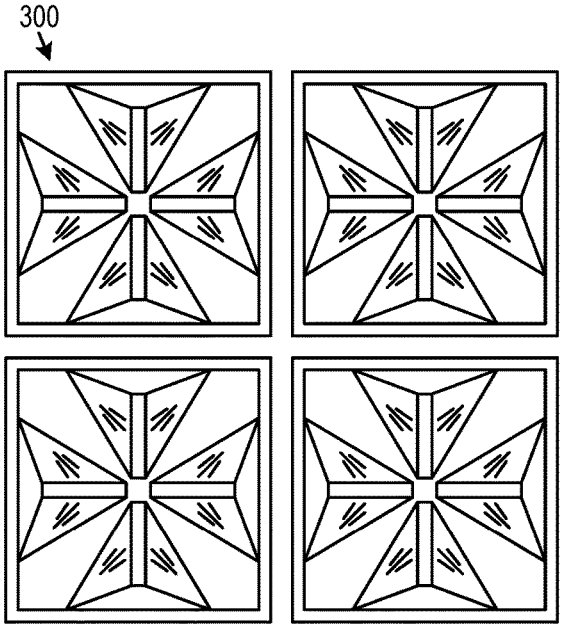
FIG. 3A-D are top plan views of configurations for arranging multiple instances of the antenna element of FIG. 1A-H into an antenna array in accordance with embodiments of the invention.
Figure 3B:
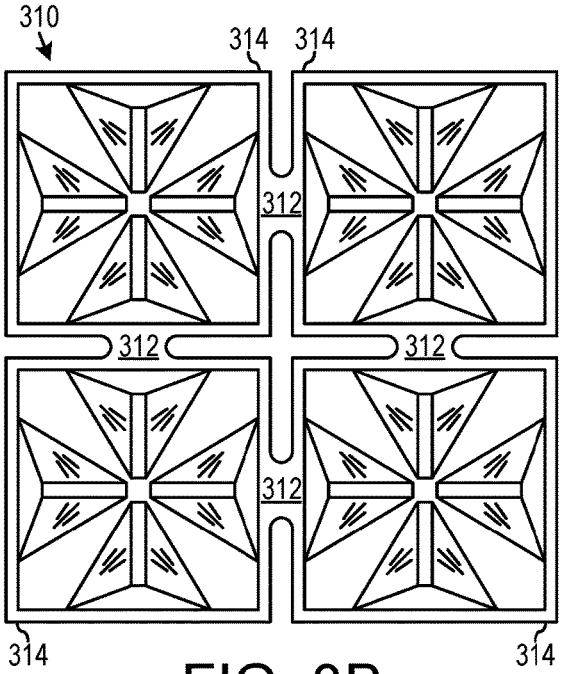
Figure 3C:
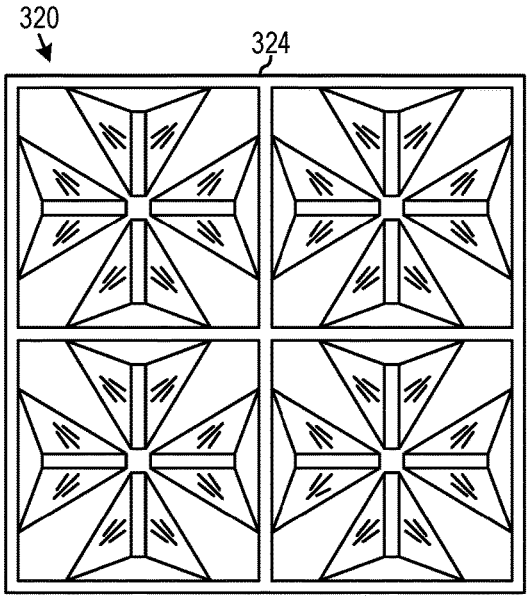
Figure 3D:
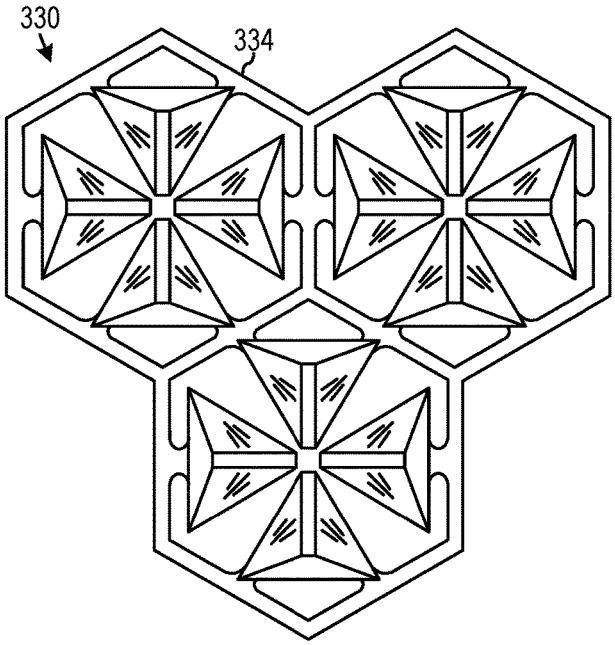

FIG. 3A-D are top plan views of configurations for arranging multiple instances of the antenna element 100 of FIG. 1A-H into antenna arrays 300, 310, 320, and 330 in accordance with embodiments of the invention. Each antenna array 300, 310, 320, or 330 includes a multiple instances of the antenna element 100 for transferring the radiofrequency signal 102 or 104 and for dissipating the heat 106. FIG. 3A shows an antenna array 300 with unconnected antenna elements. FIG. 3B shows an antenna array 310 with connections 312 between the peripheral walls 314 of the antenna elements. To form a unitary assembly of antenna array 310 of FIG. 3B, the peripheral walls 314 of adjacent element instances are adjoined with connections 312 along the X-axis or the Y-axis within the antenna array 310. FIG. 3C shows an antenna array 320 with antenna elements connected through shared peripheral walls 324. FIG. 3D shows an antenna array 330 with antenna elements hexagonally connected through shared hexagonal walls 334.

From the above description of Dual-Polarization Heat-Dissipating Antenna Array Element, it is manifest that various techniques may be used for implementing the concepts of antenna element 100 and antenna arrays 300, 310, 320, and 330 without departing from the scope of the claims. The described embodiments are to be considered in all respects as illustrative and not restrictive. The apparatus/method disclosed herein may be practiced in the absence of any component that is not specifically claimed and/or disclosed herein. It should also be understood that antenna element 100 and antenna arrays 300, 310, 320, and 330 are not limited to the particular embodiments described herein, but are capable of many embodiments without departing from the scope of the claims.

We claim:

1. An antenna element for an antenna array for transferring a radiofrequency signal and for dissipating heat, the antenna element comprising:

a periphery with a length along an X-axis approximately equaling a width along a Y-axis; and a first pair and a second pair of fins extending along a Z-axis inside the periphery, the first pair of fins separated by a shared gap along the X-axis for transferring a first polarization of the radiofrequency signal, and the second pair of fins separated by the shared gap along the Y-axis for transferring a second polarization of the radiofrequency signal that is orthogonal to the first polarization, wherein, at each height along the Z-axis between a bottom and a top of the first and second pairs of fins along the Z axis, the first pair of fins linearly broadens along the Y-axis with increasing distance along the X-axis from the shared gap towards the periphery, and, at each height along the Z-axis between the bottom and the top, the second pair of fins linearly broadens along the X-axis with increasing distance along the Y-axis from the shared gap towards the periphery.

2. An antenna array comprising a plurality of instances of the antenna element of claim 1, the antenna array for transferring the radiofrequency signal and for dissipating the heat, wherein, to form a unitary assembly of the antenna array, the peripheral wall of each first instance of the instances and the peripheral wall of each second instance of the instances are adjoined when the first and second instances are disposed adjacent to each other along either the X-axis or the Y-axis within the antenna array.

3. The antenna element of claim 1, wherein, the first pair of fins linearly broadens along the Y-axis to a same breadth at the periphery for each height along the Z-axis between the bottom and the top even though the shared gap between the first pair of fins monotonically increases from the bottom to the top, and the second pair of fins linearly broadens along the X-axis to the same breadth at the periphery for each height along the Z-axis between the bottom and the top even though the shared gap between the second pair of fins monotonically increases from the bottom to the top.

4. The antenna element of claim 1, wherein the first pair of fins and the shared gap are configured to radiate and/or collect the first polarization of the radiofrequency signal, and the second pair of fins and the shared gap are configured to radiate and/or collect the second polarization of the radiofrequency signal.

5. The antenna element of claim 1, wherein the first polarization of the radiofrequency signal is a first linear polarization and the second polarization of the radiofrequency signal is a second linear polarization, and the first linear polarization is perpendicular to the second linear polarization.

6. The antenna element of claim 1, wherein the first and second pairs of fins are composed of metal for conveying the heat and for passively dissipating the heat through radiation and convection.

7. The antenna element of claim 1, further comprising:

a first feedline for driving a second fin of the fins of the first pair, which includes a first fin and the second fin; and a second feedline for driving a fourth fin of the fins of the second pair, which includes a third fin and the fourth fin.

8. The antenna element of claim 7, further comprising:

a first balun, a first feedline coupling through the first balun for driving a first fin of the first pair; and a second balun, the second feedline coupling through the second balun for driving a third fin of the second pair.

9. The antenna element of claim 8, further comprising a printed circuit board, wherein the first feedline, the second feedline, the first balun, and the second balun are each implemented with a respective conductive layer of the printed circuit board.

10. The antenna element of claim 9, wherein the first feedline in the respective conductive layer and the second feedline in the respective conductive layer cross perpendicular to each other underneath the shared gap along the Z-axis, but separated along the Z-axis by a dielectric layer of the printed circuit board.

11. The antenna element of claim 9, further comprising: a transceiver circuit mounted on the printed circuit board opposite the first and second pairs of fins, the first and second pairs of fins dissipating the heat conveyed through the printed circuit board from the transceiver circuit when the transceiver circuit transmits and/or receives the first and second polarizations of the radiofrequency signal.

12. The antenna element of claim 11, further comprising an antenna controller adapted to control an amplitude gain and a phase delay of the radiofrequency signal passing through the transceiver circuit for electronically steering a direction and a composite polarization of an antenna beam for transmitting and/or receiving the radiofrequency signal.

13. The antenna element of claim 1, further comprising:

a printed circuit board supporting the first and second pairs of fins; and a transceiver circuit mounted on the printed circuit board opposite the first and second pairs of fins, the first and second pairs of fins for dissipating the heat conveyed through the printed circuit board from the transceiver circuit when the transceiver circuit transmits and/or receives the first and second polarizations of the radiofrequency signal.

14. The antenna element of claim 13, further comprising an antenna controller adapted to control a respective amplitude gain and a respective phase delay of the radiofrequency signal passing through the transceiver circuit for electronically steering a direction and a composite polarization of an antenna beam for transmitting and/or receiving the radiofrequency signal.

* * * * *